US008066497B2

(12) United States Patent
Hebisch et al.

(10) Patent No.: US 8,066,497 B2
(45) Date of Patent: Nov. 29, 2011

(54) PUMP WITH SIDE SURFACE COATING

(75) Inventors: Waldemar Hebisch, Darmstadt (DE); Markus Meitinger, Eppstein (DE); Karl Prinzhorn, Woellstadt (DE); Dirk Webert, Bad Homburg (DE)

(73) Assignee: LuK Fahrzeug-Hydraulik GmbH & Co. KG, Bad Homburg v.d.H. (DE)

( * ) Notice: Subject to any disclaimer, the term of this patent is extended or adjusted under 35 U.S.C. 154(b) by 396 days.

(21) Appl. No.: 11/299,932

(22) Filed: Dec. 12, 2005

(65) Prior Publication Data

US 2006/0153722 A1 Jul. 13, 2006

(30) Foreign Application Priority Data

Dec. 18, 2004 (DE) ..... 10 2004 061 019

(51) Int. Cl.
*F04C 15/00* (2006.01)
*F04C 29/00* (2006.01)

(52) U.S. Cl. ..... 418/179

(58) Field of Classification Search ..... 418/59, 418/61.2, 179
See application file for complete search history.

(56) References Cited

U.S. PATENT DOCUMENTS

| | | | | | |
|---|---|---|---|---|---|
| 3,359,953 | A * | 12/1967 | Groth | ..... | 418/179 |
| 3,705,818 | A * | 12/1972 | Grosseau | ..... | 205/183 |
| 4,067,671 | A * | 1/1978 | Goloff | ..... | 418/149 |
| 4,099,490 | A * | 7/1978 | Dobler | ..... | 123/210 |
| 4,549,862 | A * | 10/1985 | Stich et al. | ..... | 418/133 |
| 4,618,318 | A * | 10/1986 | Hansen | ..... | 418/111 |
| 6,152,716 | A | 11/2000 | Agner | ..... | 418/132 |
| 6,250,900 | B1 * | 6/2001 | Gostomski | ..... | 418/178 |
| 6,402,488 | B2 * | 6/2002 | Watanabe et al. | ..... | 418/178 |
| 6,568,928 | B2 * | 5/2003 | Gennami et al. | ..... | 418/55.4 |
| 6,641,380 | B1 | 11/2003 | Nied-Menninger et al. | .. | 418/104 |

* cited by examiner

*Primary Examiner* — Mary A Davis
(74) *Attorney, Agent, or Firm* — Davidson, Davidson & Kappel, LLC

(57) ABSTRACT

In a preferred embodiment of the present invention, a positive-displacement pump, in particular a vane cell pump, having a pump element, in particular a rotor, which is situated within a contour ring and rotatable between two side surfaces where a limited coating is located on at least one of the side surfaces.

21 Claims, 2 Drawing Sheets

PUMP WITH SIDE SURFACE COATING

This claims priority to German Patent Application No. 10 2004 061 019.3 filed Dec. 18, 2004 and hereby incorporated by reference herein.

BACKGROUND

The present invention relates to a positive-displacement pump, in particular a vane cell pump, having a pump element, in particular a rotor, which is situated within a contour ring and rotatable between two side surfaces which are provided with a coating. The present invention also relates to a method for manufacturing a coated side surface of a preliminarily described positive-displacement pump.

Positive-displacement pumps, vane cell pumps in particular, of the generic type are known. They have a rotor which rotates between two housing side surfaces or side plates within a contour ring which is also referred to as a stroke ring. The rotor is pivoted and has radial slots into which vanes are displaceably inserted. The rotor, the stroke ring, and the housing side surfaces or side plates delimit between two adjacent vanes a displacer space whose volume changes when the rotor is caused to rotate. This results in a volume increase on the intake side of the vane cell pump which causes an intake of a working medium into the respective displacer space, and a volume decrease on the delivery side which causes conveyance of the working medium out of the respective displacer space. Corresponding to the rotary motion of the rotor, an intake section and a delivery section are formed, the intake section being situated in the area of increasing volumes and the delivery section in the area of decreasing volumes. The intake section is linked to an intake connector of the vane cell pump and the delivery section is linked to a delivery connector. Friction may occur during operation on the contact surfaces between the rotor and the housing side surfaces.

U.S. Pat. No. 6,641,380 discloses a vane pump where a contour or cam ring is between two sides provided by a cover and a pressure plate. U.S. Pat. No. 6,641,380 is hereby incorporated by reference herein. U.S. Pat. No. 6,152,716 discloses a vane pump with a contour ring is provided between two pressure plates forming the sides.

BRIEF SUMMARY OF THE INVENTION

An object of the present invention is to create a positive-displacement pump, in particular a vane cell pump, having a pump element, in particular a rotor, which is situated within a contour ring and rotatable between two side surfaces which are provided with a coating, which has a longer service life than conventional positive-displacement pumps.

In a positive-displacement pump, in particular a vane cell pump, having a pump element, in particular a rotor, which is situated within a contour ring and rotatable between two side surfaces which are provided with a coating, the object is achieved in that at least one of the side surfaces is locally coated only in the area where the contour ring abuts. According to the present invention, the entire area where the contour ring abuts may be provided with a coating. However, it is also possible for only part of the area where the contour ring abuts to be provided with a coating. The positive-displacement pump is preferably a vane cell pump. However, it may also be a roller cell pump or a gear pump. The contour ring is also referred to as a stroke ring. It has been found within the scope of the present invention that in the case of an entirely coated side surface within the contour ring parts of the coating may come loose, which may result in damage. According to the present invention, the area of the side surface within the contour ring is omitted from the coating.

A preferred exemplary embodiment of the positive-displacement pump may be characterized in that the coated area of the side surface is essentially formed by an annular disc surface. The inside contour and the outside radius of the annular disc surface preferably correspond at least approximately to the inside contour and the outside radius of the contour ring, the contour having an essentially elliptical form. Another preferred exemplary embodiment of the positive-displacement pump is characterized in that the coating is provided only in a subarea of the area of the side surface where the contour ring abuts. The coating is preferably formed from a harder material than the side surfaces. Applying the coating only in a subarea has the effect that the contour ring, preferably radially inside, also partially abuts the softer material of the side surfaces, thereby increasing the tightness.

Another preferred exemplary embodiment of the positive-displacement pump may be characterized in that the coated subarea of the area of the side surface, where the contour ring abuts, is formed by an annular disc surface whose inside contour is larger than the inside contour of the contour ring. The outside radius of the annular disc surface is preferably as large as the outside radius of the contour ring.

Another preferred exemplary embodiment of the positive-displacement pump is characterized in that the coating on the side surface is raised. This type of coating may be created by covering the areas of the side surface not to be coated, for example.

Another preferred exemplary embodiment of the positive-displacement pump is characterized in that the coating is embedded in the side surface. This makes it possible for the partially coated side surface, viewed as a whole, to have a planar surface area.

Another preferred exemplary embodiment of the positive-displacement pump is characterized in that the side surface to be coated is preferably made of aluminum or an aluminum alloy. The coating is preferably an oxide layer which is also referred to as an eloxal layer. The coating is applied via electrolysis, also referred to as anodization or anodic oxidization, in which the workpiece to be coated is used as the anode and a lead plate, for example, is used as the cathode; both are inserted into a reaction space or are adjacent thereto. An electrolyte, e.g., diluted sulfuric acid, flows through the reaction space. The eloxal layer, created via anodization, is hard and highly resistant to chemical effects.

A first method for manufacturing a coated side surface of a previously described positive-displacement pump may include the following steps: The area of the side surface not to be coated is covered prior to application of the coating; the coating is subsequently applied to the uncovered area of the side surface. This has the advantage that the area not to be coated may be completely excluded during application of the coating.

A second method for manufacturing a coated side surface of a previously described positive-displacement pump may include the following steps: Prior to application of the coating, the area to be coated is machined in such a way that the area to be coated is depressed vis-à-vis the area not to be coated; the entire side surface is subsequently coated; finally, the coating is removed from the area not to be coated. This approach has the advantage that the coating of the area not to be coated is raised vis-à-vis the coating of the area of the side surface to be coated. This simplifies removal of the coating from the area of the side surface not to be coated.

A preferred exemplary embodiment of the method may be characterized in that the area to be coated is machined. A step is preferably lathed to the side surface.

Another preferred exemplary embodiment of the method may be characterized in that the removal of the coating from the area not to be coated is carried out by machining, by taking the finishing cut, for example. However, the entire side surface is also lapped. In this process, the raised area of the side surface is initially removed and thus so is the area where no coating is desired.

BRIEF DESCRIPTION OF THE DRAWINGS

Additional advantages, features and details of the present invention arise from the following description in which different exemplary embodiments are explained in greater detail, in which.

DETAILED DESCRIPTION OF A PREFERRED EMBODIMENT

Figure 3:
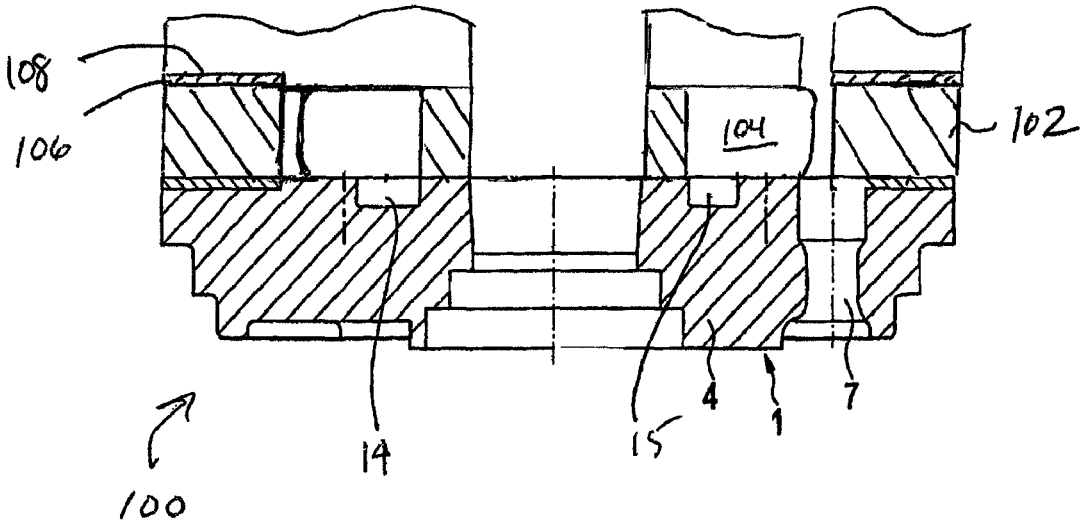
FIG. 3 shows schematically a pump bearing the side plate of FIG. 2.

The positive-displacement pump according to the present invention is preferably a vane cell pump 100 as shown schematically in FIG. 3. However, it may also be a roller cell pump or a gear pump. Such pumps may be used as steering aid pumps for motor vehicles, for example.

The vane cell pump according to the present invention may include a rotor, which has essentially the form of an annular disc. The rotor is rotatably situated within a stroke ring. The stroke ring in turn is situated between two side surfaces of a housing, which may have a one-part or a multi-part design. The side surfaces may also be formed by side plates within a housing.

The inside contour of the stroke ring may be selected in such a way that two diametrically opposed pump spaces are formed between the outside periphery of the rotor and the inside surface of the stroke ring. The inside contour of the stroke ring has two small-circle areas whose diameters essentially correspond to the outside diameter of the rotor. Furthermore, the inside contour of the stroke ring has two large-circle areas whose diameters are larger than the outside diameter of the rotor, thereby creating the pump spaces. The small-circle areas and the large-circle areas are connected by transition areas, which results in an essentially elliptical contour.

The rotor has a peripheral surface in the shape of a circular cylinder jacket, which is delimited by two circular end faces. Distributed across its peripheral surface, the rotor has multiple radially running slots. Radially movable vanes are situated within the slots and extend across the total width of the rotor.

The rotor, the stroke ring, and the housing side surfaces delimit between two adjacent vanes a displacer space whose volume changes when the rotor rotates. This results in a volume increase on the suction side of the vane cell pump which causes an intake of a working medium into the displacer space. At the same time volume decreases on the delivery side of the vane cell pump which causes conveyance of the working medium out of the respective displacer space. Corresponding to the rotational motion of the rotor, intake sections and delivery sections are formed. The intake sections are linked to intake connectors of the vane cell pump via intake pockets, while the delivery sections are linked to delivery connectors of the vane cell pump via delivery pockets. These side surfaces of the housing are in sealing contact with the end faces of the rotor and the side edges of the vanes.

Figure 1:
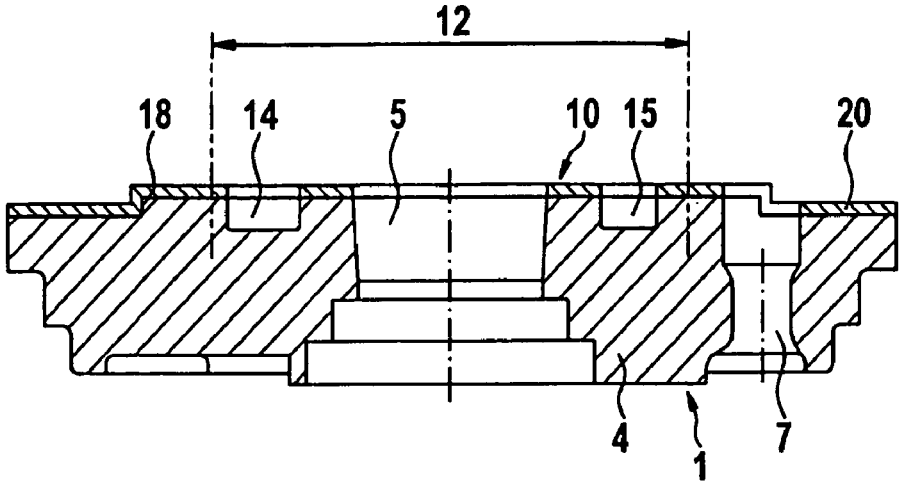
FIG. 1 shows a side plate of a vane cell pump according to the present invention after the application of a coating.
Figure 2:
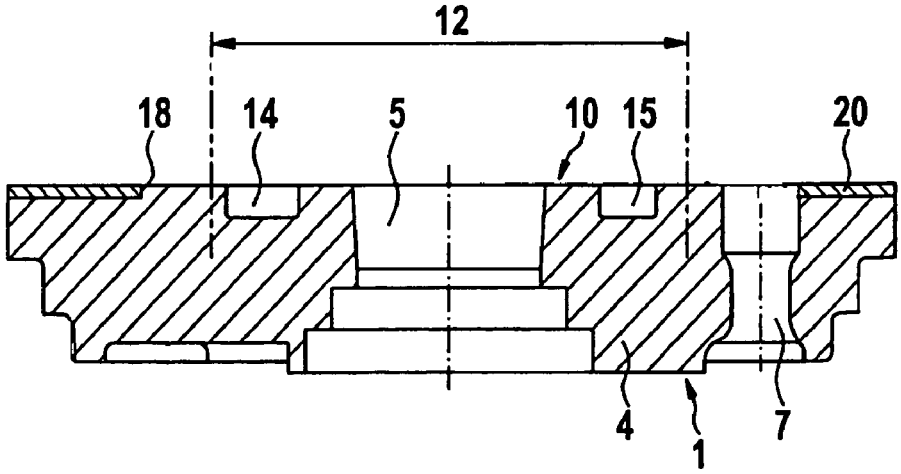
FIG. 2 shows the side plate from FIG. 1 after final machining.

FIGS. 1 and 2 show a section of a side plate 1 of a vane cell pump according to the present invention. Side plate 1 has essentially the form of an annular disc 4 which has a central through-hole 5. Central through-hole 5 is used for guiding through a drive shaft which in turn is used to drive the rotor. In addition, at least one further through-hole 7, which represents the delivery or intake pocket, is cut out of side plate 1.

As shown in FIG. 2 and FIG. 3, one end face of side plate 1 forms a side surface 10 which, in the assembled state, delimits the interior of the positive-displacement pump on one side. Side surface 10 has a central area 12 radially inside which is delimited radially outside by a contour ring 102, such as the rings shown in incorporated by reference U.S. Pat. Nos. 6,152,716 and 6,641,380. Under-vane grooves 14, 15 having an oblong-shaped cross section are provided in area 12 (FIG. 2). During operation of the positive-displacement pump 100, under-vane chambers, which are formed in the rotor radially within the vanes 104 in slots, are directed past under-vane grooves 14, 15 and pressure is applied thereto. This under-vane supply ensures that the vanes are always in contact with the inside contour of the stroke ring or the contour ring 102 during operation. Second side 108 may also have a coating 106.

A step 18 is lathed into side surface 10 radially outside of area 12. This step 18 makes it possible for the part of side surface 10, which is situated radially outside of step 18, to be recessed with respect to the rest of the side surface.

In FIG. 1, the entire side surface 10 is provided with a coating 20. The thickness of coating 20 is uniform throughout. Step 18 makes it possible for the area of coating 20 within circumferential step 18 to be raised vis-à-vis the area radially outside of step 18.

The coating is preferably applied by electrolysis. During the electrolysis process, direct current flows for some time through an electrolytic bath, i.e., through an electrolyte. The electrolyte is accommodated in a reaction space which may be formed by a chamber which is sealed off from the surroundings. When direct current flows through the electrolyte, oxygen is created at an anode which compounds with the aluminum, from which side surface 10 is preferably made, to form a firmly adhering oxide layer ($Al_2O_3$), also referred to as the eloxal layer.

After application of the coating to the entire side surface 10, the side surface is lapped or the finishing cut is made. The raised area radially inside of step 18 of side surface 10, also referred to as the bearing surface, is initially removed. This means that the coating in the area in which no coating is desired is mechanically removed. Compared to conventional methods, this method does not affect the cost since the work steps of machining the bearing surface and final lapping are necessary anyway for achieving an adequate surface quality.

FIG. 2 shows side plate 1 from FIG. 1 after removal of the coating radially inside of step 18. As can be seen, the coating is not only removed in area 12 but also partially in the area radially outside of area 12 and radially inside of step 18. Coating 20 has essentially the form of an annular disc whose outside diameter corresponds to the outside diameter of side plate 1. The inside contour of the annular disc, which preferably has an oblong-shaped cross section, is preferably slightly larger than the inside contour of the contour ring. However, the inside contour of the annular disc of coating 20 may also be the same size as the inside contour of the contour ring.

Application of local coating 20 may also be carried out by covering the surface areas not to be coated. This approach has the advantage that indentations in side surface 10, such as under-vane grooves 14, 15 or partly the delivery and intake pockets, are also free of coating.

The eloxal layer prevents the contour ring from working itself into the side plates due to micro-movements during operation. The aluminum surface of the pressure plates should be used as an abutment surface in the area of the rotor or the vanes in the event of contact or friction since aluminum against steel (rotor and vanes) has a better anti-seizure performance than an eloxal layer and, during plate bending under pressure, an eloxal layer may even create flaking splints which destroy the pump.

LIST OF REFERENCE NUMERALS

1. side plate
4. annular disc
5. through-hole
7. through-hole
10. side surface
12. area not to be coated
14. under-vane groove
15. under-vane groove
18. step
20. coating

What is claimed is:

1. A positive-displacement pump comprising:
a first side surface;
a second side surface;
a contour ring including a first axial side and a second axial side mounted between the first and second side surfaces so that a chamber is formed defined by an inner surface of the contour ring, the first side surface and the second side surface and so the first axial side is adjacent to the first side surface and the second axial side is adjacent to the second side surface;
a pump element situated within the chamber and rotatable between the first and second side surfaces; and
a coating on at least one of the first side surface and the second side surface, the coating not extending beyond a radial abutting surface of at least one of the first axial side and the second axial side of the contour ring and is only provided in a subarea of the area of the at least one of the first side surface and the second side surface abutting the contour ring.

2. The positive-displacement pump as recited in claim 1 wherein the coated area of the at least one of the first side surface and the second side surface defines at least one annular disc.

3. The positive-displacement pump as recited in claim 1 wherein the coated subarea of the area defines at least one annular disc with an inside contour larger than an inside contour of the contour ring.

4. The positive-displacement pump as recited in claim 1 wherein the subarea is depressed and the coating is applied on the entire at least one of the first side surface and the second side surface forming a raised surface on the area of the at least one of the first side surface and the second side surface not to be coated, which the raised surface is then removed.

5. The positive-displacement pump as recited in claim 1 wherein the coating is embedded in the at least one of the first side surface and the second side surface.

6. The positive-displacement pump as recited in claim 1 wherein the at least one of the first side surface and the second side surface is made of aluminum or an aluminum alloy.

7. The positive-displacement pump as recited in claim 1 wherein both the first side surface and the second side surface have the coating.

8. The positive-displacement pump as recited in claim 1 wherein the positive-displacement pump is a vane pump and the pump element is a rotor.

9. The positive-displacement pump as recited in claim 1 wherein the contour ring is fixedly mounted between the first and second side surfaces.

10. The positive-displacement pump as recited in claim 1 wherein the coating is not provided in any area of any rotating parts.

11. The positive-displacement pump as recited in claim 1 wherein the coating is an oxide layer.

12. The positive-displacement pump as recited in claim 1 wherein the coating is applied to the at least one of the first side surface and the second side surface by electrolysis.

13. A positive-displacement pump comprising:
a first side plate having a first side wall;
a second side plate having a second side wall;
a non-rotatable contour ring including a first axial side and a second axial side mounted between the first side wall and second side wall so that a chamber is formed defined by the inner surface of the contour ring, the first side wall and the second side wall and so the first axial side is adjacent to the first side wall and the second axial side is adjacent to the second side wall;
a pump element situated within the chamber and rotatable between the first side wall and second side wall; and
a coating on the first side wall only, the coating not extending beyond a radial abutting surface of the first axial side of the contour ring and the coating is only provided in a subarea of the area of the first side wall abutting the contour ring.

14. The positive-displacement pump as recited in claim 13 wherein the coated area of the first side wall defines at least one annular disc.

15. The positive-displacement pump as recited in claim 13 wherein the coated subarea of the area defines at least one annular disc with an inside contour larger than an inside contour of the contour ring.

16. The positive-displacement pump as recited in claim 13 wherein the subarea is depressed and the coating is applied on the entire first side wall forming a raised surface on the area of the first side wall not to be coated, which the raised surface is then removed.

17. The positive-displacement pump as recited in claim 13 wherein the coating is embedded in the first side wall.

18. The positive-displacement pump as recited in claim 13 wherein the first side wall is made of aluminum or an aluminum alloy.

19. The positive-displacement pump as recited in claim 13 wherein the positive-displacement pump is a vane pump and the pump element is a rotor.

20. The positive-displacement pump as recited in claim 13 wherein the contour ring is fixedly mounted between the first and second side walls.

21. The positive-displacement pump as recited in claim 13 wherein the coating is not provided in any area of any rotating parts.

* * * * *